US005685755A

United States Patent [19]

Zabasajja et al.

[11] Patent Number: 5,685,755

[45] Date of Patent: Nov. 11, 1997

[54] NON-ASBESTOS DIAPHRAGM SEPARATOR

[75] Inventors: John N. Zabasajja; John W. Gross, Sr., both of Baton Rouge, La.; Robert E. Aikman, Jr., Lake Jackson, Tex.; Charles W. Martin, Central, S.C.

[73] Assignee: The Dow Chemical Company, Midland, Mich.

[21] Appl. No.: 525,969

[22] Filed: Sep. 7, 1995

[51] Int. Cl.[6] ..... D04H 1/58

[52] U.S. Cl. ..... 442/129; 442/417

[58] Field of Search ..... 428/288, 294

[56] References Cited

U.S. PATENT DOCUMENTS 4,853,101 8/1989 Hruska et al. .

*Primary Examiner*—Helen Lee

[57] ABSTRACT

A bonded, non-asbestos chlor-alkali diaphragm comprising one or more water-wettable materials and one or more chemically-resistant materials, which is characterized by having a Macmullin number and average diaphragm thickness such that the product of these is between about 5 and about 30 millimeters when the average diaphragm thickness is measured in millimeters, and by a median pore size between about 0.1 microns and about 1 micron, wherein one or more of the chemically-resistant materials is or are coated with a durable, adherent coating of an ion-containing polymer which is bonded into the diaphragm on such materials.

16 Claims, No Drawings

NON-ASBESTOS DIAPHRAGM SEPARATOR

The present invention relates to electrolytic diaphragm-type separators for use in diaphragm-based chlor-alkali cells, and more particularly to the development of non-asbestos diaphragms wherein the use of closely-regulated, conventional asbestos fibers is omitted.

BACKGROUND

In recent years particularly, a significant effort has been made to develop and commercialize non-asbestos diaphragms to replace the conventional asbestos diaphragms which have been used in the diaphragm-type chlor-alkali cells to date. The conventional asbestos diaphragms possess a desirable combination of performance, low cost and durability, but also pose a health risk and environmental hazard, and as such have become highly regulated. Unfortunately, the non-asbestos diaphragms which have been developed heretofore have been lacking in one or more respects in attempting to duplicate or exceed the performance of bonded asbestos diaphragms, without posing the health risk and environmental hazard associated with asbestos.

The non-asbestos diaphragms which have been known or described in the art heretofore are comprised of a variety of materials, but in general terms may be described as being comprised of one or more water-wettable materials whose chemical resistance is less than desired, and one or more suitable chemically-resistant but less wettable materials. Various attempts have accordingly been made to improve the wettability of these more chemically-resistant materials, poly(tetrafluoroethylene) or PTFE being a typical such material.

Several of these efforts have focused on the incorporation of ion-exchange materials by the coating of PTFE as well as by other means. An example may be found in U.S. Pat. No. 4,169,024 to Fang, wherein PTFE (or a similar fluoroplymer) in the form of a powder or fibers, in an unsupported porous or nonporous film, in a coating on an inert fabric or in a porous reinforced structure (that is, a diaphragm) is chemically modified by reaction with a sulfur- or phosphorus-containing compound.

U.S. Pat. No. 4,720,334 to DuBois et al. is also representative, and describes diaphragms containing a fibrillated fluorocarbon polymer such as PTFE and a fluorocarbon ionomer (preferably containing carboxylic acid, sulfonic acid, alkali metal carboxylate or alkali metal sulfonate functionality), and optionally further containing a minor amount of a wettable inorganic particulate material. The diaphragm is dried and secured upon an underlying cathode by being heated to a temperature below the sintering temperature of PTFE for a time, a suggested upper limit being about 225 degrees Celsius.

The ionomer can be incorporated in the diaphragm of the DuBois patent by codeposition from a slurry with the ionomer being included as a solid, gel or solution, by being coated on either or both of the fluorocarbon fibrils and inorganic particulate and then deposited from a slurry, or by being extruded in admixture with the fluoropolymer before it is fibrillated. Specific coating processes for coating the PTFE fibrils are described, including mixing PTFE powder with a solution of ionomer in a water-miscible solvent under high shear conditions, then dispersing the coated fibrils by blending with water and some surfactant. Thereafter the materials are deposited onto the cathode from the resulting slurry.

None of the coatings and none of the diaphragms produced by these earlier processes, however, have been entirely satisfactory.

Summary of the Present Invention

The present invention represents a significant improvement in the construction of bonded non-asbestos chlor-alkali diaphragms comprising one or more water-wettable materials and one or more suitably chemically-resistant materials, wherein the wettability of some or all of the chemically-resistant materials employed or to be employed in a given such diaphragm is increased and the tendency of the diaphragm to gas-blinding and dewetting over time decreased, through the application prior to a bonding step of an economically thin, durable coating of an ion-containing polymer or of a thermoplastic precursor thereof on some or all of the chemically-resistant materials by one of three methods.

A first embodiment of a process for making such diaphragms would employ a coating process described more fully in commonly-assigned, copending U.S. application Ser. No. 08/404,476, filed Mar. 14, 1995 for "Processes for Forming Thin, Durable Coatings of Ion-Containing Polymers on Selected Substrates" (the '476 application) and hereby incorporated by reference herein.

In the context of the referenced coating process, the chemically-resistant materials to be coated are contacted with a colloidal, surface active dispersion of an ion-containing polymer and then the dispersion-wetted materials (while still wetted with the colloidal dispersion or solution (excess dispersion can be removed from contact with the chemically-resistant materials)) are contacted with a solution of a salt or of a strongly ionizing acid which is of a sufficient concentration to cause a preferably essentially continuous adherent coating of the ion-containing polymer to be formed on the surface of the chemically-resistant materials.

The salt-contacting step is in this first embodiment preferably conducted through the preparation of a NaCl- or $Na_2CO_3$-based draw slurry included the dispersion-wetted materials, and the diaphragm drawn therefrom is dried and bonded, with the bonding step providing an annealing of the coated materials whereby the adhesion of the coating to the materials is enhanced as compared to an unannealed, coated material.

A second, generally more preferred embodiment would employ a coating process as described in commonly-assigned, copending U.S. application Ser. No 08/404,480, filed Mar. 14, 1995 for a "Solventless Process for Forming Thin, Durable Coatings of Perfluorocarbon Ionomers on Various Polymeric Materials" (the '480 application), which application is also incorporated herein by reference. The incorporated application describes a solventless coating process which involves adding a colloidal, surface active dispersion in water of a perfluorocarbon ionomer and a salt or a strongly ionizing acid to a vessel containing a polymeric chemically-resistant substrate such as PTFE, with the salt or acid being added in an amount such that a solution results of a sufficient ionic strength to cause an adherent, preferably essentially continuous coating of the perfluorocarbon ionomer to be formed on the surface of the powdered and/or fibrous PTFE under conditions of high shear or significant agitation, and subjecting the dispersion, salt or acid and PTFE materials to such conditions whereby a thin, durable coating of the perfluorocarbon ionomer is formed on the PTFE materials.

In the context of the present invention, conventionally the salt employed is NaCl or $Na_2CO_3$ for forming a draw slurry including the coated PTFE or other chemically-resistant material to be incorporated in the diaphragm, and the remaining diaphragm constituents are incorporated with the salt solution/ionomer dispersion/PTFE mixture to form the draw slurry directly. Thereafter the slurry is drawn through a foraminous support to form a diaphragm thereon, and the diaphragm dried and bonded as in the first embodiment.

In a third, most preferred embodiment, a process is provided as more fully described in commonly-assigned U.S. application Ser. No. 08/525,968, filed concurrently herewith for "Improved Processes for Forming Thin, Durable Coatings of Perfluorocarbon Ionomers on Various Substrate Materials" and incorporated by reference herein, for manufacturing a diaphragm for use in a chlor-alkali diaphragm cell which comprises coating a substrate which is to be incorporated into the diaphragm and with respect to which an improvement in hydrophilicity is desired (for example, PTFE fibers or powder, or a fiber composite of the type described in U.S. Pat. No. 4,853,101 to Hruska et al. which includes PTFE fibers or fibrils) with the thermoplastic, sulfonyl fluoride precursor of the known perfluorosulfonic acid form and perfluorosulfonate salt form ionomers via an aqueous surface active dispersion containing the precursor, forming an aqueous draw slurry including the coated substrate with sodium carbonate or sodium chloride, drawing a diaphragm from the draw slurry through vacuum deposition on a diaphragm support, drying and then bonding the diaphragm under bonding conditions, and only thereafter hydrolyzing the sulfonyl fluoride precursor within the bonded diaphragm to its perfluorosulfonate, sodium salt form ionomer through contact with sodium hydroxide.

A bonded diaphragm encompassed by the present invention and made according to any one of these three embodiments is fundamentally comprised of one or more water-wettable materials and one or more suitably chemically-resistant materials, and possesses a characteristic combination of porosity, tortuosity and diaphragm thickness such that the product of the Macmullin number (Nmac, the dimensionless ratio of the diaphragm's tortuosity to its porosity) and average diaphragm thickness in millimeters (t) for such diaphragm is between about 5 and about 30 millimeters and the median pore size is between about 0.1 microns and about 1 micron for current densities ranging from about 0.2 amps per square inch to about 1 to 2 amps per square inch of diaphragm area, with the Nmac×t value preferably ranging from about 5 to about 25 millimeters and the median pore diameter being preferably from about 0.1 microns to about 0.7 microns, and the Nmac×t value still more preferably being greater than about 8 millimeters and the median pore diameter being between about 0.1 and about 0.5 microns, where the Macmullin number is determined by electrochemical impedance spectroscopy and application of the mathematical relationships provided in commonly-assigned U.S. Pat. No. 4,464,238 to Caldwell et al.

DETAILED DESCRIPTION OF PREFERRED EMBODIMENTS

A preferred bonded diaphragm separator for chlor-alkali cells will be constructed of zirconium oxide as a principal constituent of the diaphragm, with PTFE in fibrous and powdered forms being the other constituent materials of the diaphragm and with one or both of the PTFE materials (that is, the PTFE fibers and powdered PTFE) having a thin, durable coating of an ion-containing polymer placed thereon by one of the three methods specified above, for imparting greater hydrophilicity to the PTFE and thus improved resistance to dewetting and gas blinding to the diaphragm incorporating the same.

A preferred, first embodiment of a process for making a $ZrO_2$/PTFE fibers/PTFE particulate diaphragm having an Nmac×t value and median pore diameter in the ranges specified above, and which is suited for operation in the specified range of current densities, would employ a solventless, essentially completely water-based coating process described in the '476 application for placing a thin, durable coating of a lower equivalent weight, perfluorosulfonate ionomer on one or both of the PTFE fibers and the PTFE particulate employed as a binder in the diaphragm.

This solventless coating process can be carried out in several ways depending on the ionomer type employed and the nature of the dispersion to be used. For example, for the ionomers which have been produced by The Dow Chemical Company with a shorter side-chain (acid-form) structure, $$-(CF_2-CF_2)_a(CF_2-\underset{\underset{OCF_2CF_2SO_3H}{|}}{CF})_b-$$

wherein the ratio of a:b is typically about 7 to 1, an integrated coating process would initially and preferably involve the preparation of a dispersion in water of from about 1 to about 3 percent by weight of a perfluorosulfonic acid form ionomer having an equivalent weight of from about 550 to about 1000, and especially from about 550 to about 800 inclusive, by stirring the selected ionomer solids in a closed vessel at temperatures of from about 170 to about 200 degrees Celsius, a pressure of from about 110 pounds per square inch, absolute (psia), and over a time frame of from about 1 to about 3 hours to provide yields of dispersed ionomer solids on the order of from about 70 percent to about 95 percent or greater for an 800 equivalent weight ionomer. Preferably a powdered ionomer in the desired equivalent weight is combined with water in a closed vessel, and heated to a temperature of from about 180 to about 185 degrees Celsius with stirring for about 2 hours, with the pressure being on the order of 145 to about 165 psia. Alternatively, an available alcohol/water-based dispersion could be conventionally processed to remove the alcohol.

Where the ionomer is a perfluorosulfonic acid ionomer of the Nafion™ type, initially a dispersion could be prepared in water of up to about 10 percent of an ionomer of an equivalent weight of from 550 to 1500, according to the process and under the conditions specified in U.S. Pat. No. 4,433,082 to Grot, or more commonly a commercially-available alcohol/water-based dispersion will again be conventionally processed to remove the alcohol.

The resulting dispersion is then added to a PTFE powder, for example, which will preferably have been subjected to intensive shearing in water to produce uniformly-sized PTFE particles, or to preferably presheared PTFE fibers, or to a mixture of PTFE in particulate form and in the form of fibers. The mixture is then subjected to high shear conditions generally corresponding to a blade tip speed on the mixer used of 800 ft./minute (240 meters/minute) or greater, for a time sufficient to coat the PTFE substrate with the ionomer and achieve a uniform slurry, with care being taken to not create such heat by excessive mixing/shearing as might cause the coated PTFE to begin to clump together. It is important to note specifically here that the liquids in question are to be added to the PTFE, as opposed to the PTFE being added to the water or dispersion.

The resulting ionomer to PTFE solids ratio will generally be about 0.005 to 1 by weight or greater, preferably being from about 0.005 to 1 to about 0.015 to 1 and most preferably being approximately 0.015 to 1, with sufficient ionomer and PTFE being present for a given volume of water to achieve adequate shearing of the solids and coating of the PTFE by the ionomer. This minimum solids level can reasonably be expected to vary with different tip speeds and different mixing conditions and with different equipment, but can be determined through routine experimentation.

Those skilled in the diaphragm art will appreciate at this point, that because there is no need for a rinse step to remove the lower alcohol solvent from the coated PTFE material, the ionomer coated PTFE is preferably then contacted with the requisite salt solution in the preparation of a NaCl- or $Na_2CO_3$-based aqueous draw slurry incorporating the ionomer coated PTFE materials and the zirconium oxide, in the draw vat for drawing a non-asbestos diaphragm.

Preferably the draw slurry employed in constructing these diaphragms with this coating process or with either of the two other coating processes contemplated hereunder will have a slurry solids concentration between about 190 and about 250 grams per liter, and more preferably of about 250 grams per liter to about 280 grams per liter and higher, with the higher concentrations generally having been found to result in higher caustic current efficiencies. The slurry will generally contain from about 60 weight percent to about 81 weight percent of zirconium oxide (typically having a particle size between about 0.85 microns and about 1.7 microns), from about 14 to about 31 percent of a PTFE particulate (for example, Teflon™ 7C granular PTFE from E.I. DuPont de Nemours & Company, Inc., having an average particle size of about 30 microns), and from about 5 to about 9 weight percent of PTFE fibers (for example, as shown in the referenced, commonly-assigned application, bleached 0.25 inch long, 3.2 denier PTFE fibers). More preferably and typically, from about 75 to 76 weight percent will be zirconium oxide, with from 14 to 16 percent of the particulate PTFE and from 6 to 8 weight percent of PTFE fibers.

Sodium carbonate will preferably be used as the draw carrier, at a concentration in water which will typically be from about 3 percent by weight to about 20 percent by weight. A suspending agent will preferably be used also, with the suspending agent preferably being aluminum chloride or xanthan gum, most preferably being xanthan gum. The concentration of the suspending agent does not appear to be critical, but will be sufficient to keep the zirconium oxide in suspension, for example, between about 1.0 and about 1.8 grams per liter.

The diaphragm is vacuum drawn on a foraminous cathode which has optionally been stress relieved beforehand, for example, by heating a conventional carbon steel cathode to about 500 degrees Celsius for an hour. Preferably the drawing is accomplished at temperatures, for example, of from about 70 to about 100 degrees Fahrenheit, and with flow control of residual slurry through the vacuum flow line of the draw vat to prevent pinholing of the diaphragm.

The diaphragm is thereafter dried by continuing application of a vacuum thereon and by oven drying, or simply by oven drying. A slow, uniform drying is desired in any event to avoid blistering of the diaphragm at the preferred drying temperatures of from about 40 degrees Celsius to about 110 degrees Celsius, and where oven drying is employed preferably the diaphragm is placed in a position in the drying oven wherein the air flow surrounding the diaphragm is relatively free and uniform.

Upon completion of the drying cycle, the diaphragm is bonded in a bonding over at temperatures between about 330 degrees Celsius and about 355 degrees Celsius, with preferred temperatures being from 330 degrees Celsius up to about 345 degrees Celsius and especially being controlled at about 335 degrees Celsius for the bonding of diaphragms including PTFE which has been provided with a perfluorosulfonate, sodium form ionomer coating (as in the first and second processes for making the contemplated diaphragms, the second process being described hereafter). The sintering of the diaphragm is accomplished by slowly ramping up to the desired temperature (e.g., at about 2 degrees Celsius per minute), maintaining this temperature for a period of time, for example, about one half hour, and then slowly cooling the diaphragm at a rate for example of about 2 degrees Celsius per minute.

The resulting diaphragm will preferably be characterized by an Nmacxt value of greater than about 11 and by a median pore diameter of from about 0.1 to about 0.3 microns, and appears to be particularly well-suited for use at the lower current densities indicated above, and for the production of a cell effluent having a caustic content in the range of about 100 grams per liter to about 130 grams per liter and containing from about 160 to about 200 grams per liter of NaCl, from a saturated brine containing about 290 grams per liter of NaCl at from about 60 to about 65 degrees Celsius.

Conventionally diaphragms of the variety contemplated herein, but not including a thin, durable ionomer coating on the PTFE fibers and/or particulate materials used therein, require a periodic shutdown to add surfactant to rewet the diaphragms. As illustrated by the examples below, however, bonded diaphragms prepared according to the present invention preferably enable at least about a 30 kilowatt hour sustained average reduction in power consumption per ton of caustic produced and at least about a 1.5 percent improvement on average in power efficiency, over an interval between rewettings which is at least about twice as long as that associated with the use of a diaphragm prepared in an otherwise identical manner but not including a thin, durable ionomer coating on the PTFE fibers and/or particulate used in the diaphragm. More preferably, the recited average reduction in power consumed and average increase in power efficiency are maintained over an interval between rewettings that is at least about 2.5 times, and most preferably at least about three times, as long as for a diaphragm not incorporating the durably coated chemically-resistant materials in the manner of the present invention.

At the same time, the above-described methods of incorporating an ionomeric material into the diaphragms of the present invention each contemplate that the diaphragms including such material can and will be bonded, for example, at sintering temperatures for PTFE. It is expected that as a result of this feature, diaphragms made according to the present invention and which contain PTFE and an economically advantageous, minimum amount of ionomer will possess an increased burst strength as compared to an otherwise equivalent diaphragm which has been heated only to temperatures of about 225 degrees Celsius or less, in accordance with the teachings of U.S. Pat. No. 4,720,334 to DuBois et al., or which more generally has not been bonded at sintering temperatures for PTFE. The precise improvement that can be expected in this regard can be expected to vary somewhat depending on the materials employed in a given diaphragm and the manner in which the diaphragm is constructed. In general, however, it is expected that the diaphragms of the present invention will possess a burst strength that is at least about 5 times the burst strength shown by an otherwise equivalent diaphragm wherein the ionomer in the diaphragm is not bonded into the diaphragm, and more preferably is at least about 10 times as great, most preferably being at least about 15 times as great as the burst strength demonstrated by an otherwise equivalent diaphragm.

The Macmullin number for these diaphragms will be determined by electrochemical impedance spectroscopy, or EIS, using the mathematical relationships developed in the above-mentioned U.S. Pat. No. 4,464,238 to Caldwell et al. In this regard, the Macmullin number (Nmac) is experimentally determined by measuring the impedance of a saturated brine solution ($Z_1$) and the increased impedance occasioned by the insertion of a wet diaphragm into the cell used for the measurement ($Z_2$), and relating these impedances according to the equation:

$$Nmac=((Z_2-Z_1)/R_0)+1$$

where $$R_0=(\rho\times t)/A$$

with ρ being the resistivity of the saturated brine solution, or 1.58 ohm-in. at 25 degrees Celsius, t being the diaphragm thickness and A being the diaphragm area of the inserted diaphragm sample.

For the examples provided below, an EG&G electrochemical impedance system from Princeton Applied Research, consisting of a Model 273 potentiostat/galvanostat from EG&G and a Solartron Model 5201EC lock-in amplifier connected to a microcomputer, was employed with an H-cell. The cell was comprised of two plexiglass compartments, one compartment acting as the anolyte or working electrode chamber and the other compartment acting as the catholyte or counter electrode chamber, which are mounted together through a threaded connection.

Initially the resistance of the saturated brine solution was determined by a single sine experiment in the impedance system, starting at a frequency of 100 kHz down to a frequency of 5 kHz. The resistance of the solution without the diaphragm was assumed to correspond to the impedance $Z_1$ obtained at the 100 kHz frequency, based on an assumed equivalence of the H-cell to a Randles cell having an equivalent circuit consisting of a polarization resistance $R_p$ in series with a resistance of the solution $R_s$ (with and without the diaphragm insert), the polarization resistance $R_p$ being equal to the resistance of the working electrode in parallel with a capacitance C which was taken as corresponding to the capacitance of the double layer at the electrode-solution interface. Mathematical treatments in the impedance system determined $R_p$, C and $R_s$ from the impedance spectra resulting from measurements at the various frequencies for each diaphragm.

After obtaining the solution's impedance $Z_1$ in the described manner, a diaphragm was mounted in the cell which had been soaked in the saturated brine solution under vacuum or at ambient conditions for at least twenty-four hours, and the diaphragm's impedance $Z_2$ taken as that measured at a frequency of 100 kHz. The Macmullin numbers obtained in this manner are estimated to have a possible error of from 8 to 10 percent, based on an error of about 4 to 5 percent in the estimation of the impedances in question by this method. By comparison, the cited U.S. Pat. No. 4,464,238 to Caldwell et al. cites an estimated error of plus or minus 15 percent.

The second, generally more preferred embodiment of a process for making the preferred $ZrO_2$/PTFE fiber/PTFE particulate diaphragms would employ a batchwise, solventless coating process as described in the '480 application, and which is very similar the solventless coating process which is preferred of the first embodiment and which has just been described. The second embodiment essentially involves adding the ionomer dispersion to the draw vat containing the PTFE fibers and/or particulates along with the salt solution, zirconium oxide, xanthan gum suspending agent and perhaps adding additional water, and then on a batchwise basis shearing the resulting draw slurry intensively to coat the PTFE materials therein. The diaphragms are subsequently drawn, dried and bonded as in the first embodiment, and are otherwise constructed with the same ionomer and PTFE materials and in the same manner as in the first embodiment, and are preferably as characterized in conjunction with the description of the first embodiment of a process for making the diaphragms of the present invention.

In the third, most preferred embodiment mentioned previously, namely, an embodiment more fully described in commonly-assigned U.S. application Ser. No. 08/525,968, filed concurrently herewith for "Improved Processes for Forming Thin, Durable Coatings of Perfluorocarbon Ionomers on Various Substrate Materials", the PTFE fibers and/or particulate material which is to be included in the $ZrO_2$/PTFE fibers/PTFE particulate material diaphragm are coated with the thermoplastic, sulfonyl fluoride precursor of the desired perfluorosulfonic acid form and perfluorosulfonate salt form ionomers via an aqueous (organic solvent-free) surface active dispersion containing the precursor, forming an aqueous draw slurry including the coated substrate with sodium carbonate or sodium chloride, drawing a diaphragm from the draw slurry through vacuum deposition on a diaphragm support, drying and then bonding the diaphragm under bonding conditions, and only thereafter hydrolyzing the sulfonyl fluoride precursor within the bonded diaphragm to its perfluorosulfonate, sodium salt form ionomer through contact with sodium hydroxide. The ionomers employed in this embodiment preferably have an equivalent weight of less than about 800, and most preferably less than about 650.

As mentioned in the incorporated application, most preferably the process is accomplished in a batchwise manner in a draw vat, with the thermoplastic sulfonyl fluoride precursor, the PTFE fibers and particulate material, zirconium oxide, a suspending agent, the sodium chloride- or sodium carbonate-based draw carrier and any required additional water to achieve the desired draw slurry solids concentration being combined in the draw vat with a surfactant to keep the uncoated PTFE wetted in the draw slurry. The order of addition is not considered to be important, with premixing of some of these materials being contemplated however if desirable. Further, in this batchwise process, the PTFE may be in effect coated while the draw slurry is being formed, so that the recitation of forming the draw slurry including the coated substrate is not in the preceding paragraph to be taken as necessarily requiring that the substrate be coated in a prior, separate step before being included in the draw slurry.

The drawing, drying and bonding steps are performed as before to provide a diaphragm which is again as characterized in conjunction with the description of the first embodiment of a process for making the diaphragms of the present invention, except that whereas in the preceding two diaphragm-making process embodiments the optimal bonding temperature is slightly lower than would be conventionally employed in the absence of an ionomer coating to achieve the desired degree of sintering and flow of the PTFE for maximum diaphragm strength, in employing a coating of the thermoplastic sulfonyl fluoride precursor and only converting the precursor to its perfluorosulfonate, sodium form ionomer after the bonding or sintering of the diaphragm, temperatures approaching about 350 degrees Celsius can again be used without adversely affecting the wettability of the coated PTFE materials in the diaphragm. In general terms, the bonding oven will be controlled, at the peak of the sintering cycle, at the highest temperature possible that will not result in a temperature at any area of the diaphragm which exceeds about 355 degrees Celsius, generally being about 335 to about 350 degrees Celsius.

Clearly, while the construction of $ZrO_2$/PTFE fiber/PTFE particulate non-asbestos diaphragms has been described in detail herein, those skilled in the art will recognize that other combinations of discrete, conventional water-wettable diaphragm constituent materials and chemically-resistant but less-wettable materials can be used and made into improved diaphragms according to the teachings provided herein, and that composite fibers of the type described in U.S. Pat. No. 4,853,101 to Hruska et al., which form a composite of the inorganic particulate water-wettable materials and the chemically-resistant but less-wettable polymeric materials, can be more effectively employed in the context of a finished diaphragm including the same by being coated in the manner of the present invention, or by being combined with a discrete coated known diaphragm material. Consequently, diaphragms in which a portion of the one or more water-wettable materials are coated in addition to a chemically-resistant material or materials, are also intended to be embraced within the present invention as defined by the claims below. The chemically-resistant, polymeric materials which will fibrillate and which are useful in making the composite fibers of U.S. Pat. No. 4,853,101 to Hruska et al. can also be coated by one of the methods described herein, before being combined with the inorganic particulate materials in such a composite fiber.

ILLUSTRATIVE EXAMPLES

The present invention is more particularly illustrated by the examples which follow:

EXAMPLE 1

A draw slurry was prepared by adding 100.23 grams of zirconium oxide (median particle size of 0.85 microns) to a solids mixture containing 10.23 grams of ¼ inch long, 3.2 denier PTFE fibers and 51.3 grams of Teflon™ 7C particulate material which had been coated with an 800 equivalent weight, short side-chain form perfluorosulfonate ionomer and then contacted with alkaline brine at 65 degrees Celsius to form a thin (i.e., less than 100 nanometers thick) film of ionomer thereon. Five hundred milliliters of 5 percent $Na_2CO_3$ and 3.1 grams of Triton GR-5M dioctyl sodium sulfosuccinate anionic surfactant (Rohm & Haas Co., Philadelphia, Pa.) were added to the solids mixture, and the resulting slurry mixed in a high shear Waring blender (20,000 rpm's) for three minutes.

After mixing, the slurry was vacuum deposited on a punched plate cathode, the wet diaphragm was withdrawn and dried overnight at 100 degrees Celsius, and then bonded at temperatures between about 335 degrees Celsius and about 345 degrees Celsius for about one half-hour. The diaphragm composition after bonding was 60.2 weight percent of zirconium oxide, 30.8 weight percent of the ionomer-coated Teflon™ 7C particulate material and 9.0 weight percent of the ¼ in. PTFE fibers.

The Macmullin number and thickness of this diaphragm (Diaphragm A in Table 1 below) and of a diaphragm made in identical fashion except in using uncoated PTFE (Diaphragm B) were determined in the manner described above along with the median pore diameter of the diaphragm, the latter being measured on 25 mm diameter, surfactant solution-soaked diaphragm pieces using a Coulter Gas Flow Porometer II from Coulter Scientific Instruments, Hialeah, Fla. Diaphragms A and B were in this case each found to have an Nmac×t value of about 16.8 millimeters, with a median pore diameter of 0.25 microns.

Diaphragm A was mounted in a lab cell and initially soaked in the Zonyl FSN fluorosurfactant solution (E.I. DuPont de Nemours & Company, Inc.) before being soaked in alkaline brine. The lab cell was then operated at 10.6 amps and 75 degrees Celsius for 41 days. Diaphragm B was evaluated in a similar manner. Diaphragm A experienced a voltage increase over the 41 days of 10 millivolts, as compared to a 480 millivolt increase for Diaphragm B from its start-up voltage. Table 1 compares the caustic current efficiencies and the differences in power efficiencies and power consumption for Diaphragms A and B:

TABLE 1

| | Days | CCE[b] | Delta, Power Efficiency | Delta, Power Consumed[c] |
|---|---|---|---|---|
| A | 41 | 90 | 6.9 | (621) |
| B | 5[a] | 66 | — | — |

[a]Shut down after 5 days when voltage rose significantly and caustic gpl to 208 gpl, indicating complete dewetting;
[b]Caustic current efficiency at normal caustic contents of 100–130 gpl;
[c]In kilowatt hours per ton of caustic produced;

EXAMPLE 2

To a slurry containing 149 grams of zirconium oxide (median particle size of 0.85 microns), 10.9 grams of the same PTFE fibers used in the previous Example, and 585 grams of a 12 weight percent solution of $Na_2CO_3$ in water were added 37.1 grams of the coated Teflon™ 7C particulate used in Example 1. Three (3.0) grams of Triton GR-5M dioctyl sodium sulfosuccinate anionic surfactant (Rohm & Haas Co., Philadelphia, Pa.) were added to this slurry mixture and the slurry mixed as in Example 1. The diaphragm was drawn from the slurry, dried and bonded in the manner of Example 1, and after bonding the diaphragm was comprised of 75 weight percent of zirconium oxide, 17 percent of the 7C particulate material and 8 weight percent of the PTFE fibers. The diaphragm's Macmullin number, thickness and median pore diameter were determined as in Example 1, and the diaphragm (Diaphragm C) was soaked overnight in alkaline brine in a lab cell before being operated at 10.6 amps and 75 degrees Celsius for 42 days. An identically prepared diaphragm with uncoated PTFE (Diaphragm D) was run for comparison for 49 days. The Nmac×t value for diaphragms C and D was found to be 19.0 millimeters, with a median pore diameter of 0.31 microns. Diaphragm C experienced a 120 millivolt increase in voltage from its start-up voltage, whereas Diaphragm D experienced a 170 millivolt increase from its start-up voltage. The caustic current efficiencies and differences between the power efficiencies and power consumption for these diaphragms in the lab cell are shown in Table 2 as follows:

TABLE 2

| | Days | CCE[a] | Delta, Power Efficiency | Delta, Power Consumed[b] |
|---|---|---|---|---|
| C | 42 | 94 | 4.2 | (332) |
| D | 49 | 94 | — | — |

[a]Caustic current efficiency at normal caustic contents of 100–130 gpl;
[b]In kilowatt hours per ton of caustic produced;

EXAMPLE 3

The same materials and procedures were employed as in Example 2 above, except that a suspending agent, $AlCl_3 \cdot 6H_2O$, was added in crystalline form to the slurry at a concentration of 6.8 grams per liter. Diaphragms prepared from slurries including coated PTFE particulate materials and uncoated particulate materials were tested in a lab cell as in the previous examples, with the diaphragm including the coated PTFE particulate materials being designated as Diaphragm "E" in Table 3 and the diaphragm including uncoated PTFE being Diaphragm "F". The Nmac×t value for Diaphragms E and F was determined to be 11.0 millimeters, with a median pore diameter of 0.96 microns. The voltage increase for Diaphragm E from start-up was 80 millivolts, while Diaphragm F experienced a 140 millivolt increase from its start-up voltage. The caustic current efficiencies and differences in power efficiencies and power consumption for Diaphragms E and F are shown in Table 3 as follows:

TABLE 3

| | Days | CCE[a] | Delta, Power Efficiency | Delta, Power Consumed[b] |
|---|---|---|---|---|
| E | 94 | 95 | 3.7 | (100) |
| F | 94 | 93 | — | — |

[a]Caustic current efficiency at normal caustic contents of 100–130 gpl;
[b]In kilowatt hours per ton of caustic produced;

EXAMPLE 4

For this example, 0.5 grams of xanthan gum, a natural high molecular weight branched polysaccharide, were dispersed in 402 mL of water using the Waring high shear blender for 1 minute. Sixty grams of NaCl were added and stirred until dissolved. To this mixture was added 12.83 grams of the ¼ inch long, 3.2 denier PTFE fibers which had been premixed with a Cowles laboratory mixer, then 149.6 grams of a dispersion containing the ionomer-coated Teflon™ 7C material at 25 percent by weight with 25 percent by weight of NaCl were added. The total salt concentration in the draw slurry was at this point 150 grams NaCl per liter.

The whole mixture was stirred in a Lightnin' type mixer for 3 minutes, then 175 grams of the same zirconium oxide were added and the mixture mixed again for three minutes. A diaphragm was drawn from this slurry (Diaphragm G) and from an otherwise identical slurry (Diaphragm H) which however employed uncoated PTFE materials, in the manner of previous examples but on an intermediate scale. After drying overnight at 100 degrees Celsius, the diaphragms were bonded at 340 to 345 degrees Celsius for 20 minutes and tested as in previous examples, with Diaphragm G showing no voltage increase over 147 days from its starting voltage, and Diaphragm H showing a voltage increase of 80 millivolts from its start=up voltage. The Nmac×t value was determined to be 13.0 millimeters (where the diaphragm thickness t was measured in millimeters), with a median pore diameter of 0.18 microns. The caustic current efficiencies of Diaphragms G and H in the lab cell and the differences in power efficiencies and power consumption for G and H were as shown in Table 4:

TABLE 4

| | Days | CCE[a] | Delta, Power Efficiency | Delta, Power Consumed[b] |
|---|---|---|---|---|
| G | 147 | 94 | 1.9 | (36) |
| H | 147 | 93 | — | — |

[a]Caustic current efficiency at normal caustic contents of 100–130 gpl;
[b]In kilowatt hours per ton of caustic produced;

EXAMPLE 5

The burst strengths of several diaphragms incorporating coatings of a thermoplastic, sulfonyl fluoride precursor of a 650 equivalent weight perfluorosulfonate, sodium form ionomer before a bonding or annealing step were measured to assess the effect of the temperature employed in the heating step on the mechanical strength of the diaphragms. Each diaphragm was constructed in the manner of the third, most preferred embodiment described above, and included 75 percent by weight of zirconium oxide, 17 percent by weight of the Teflon™ 7C particulate, and 8 percent by weight of the same bleached PTFE fiber employed in previous examples.

The diaphragms were drawn, dried at 100 deg. Celsius overnight and heated to 335 degrees Celsius, 300 degrees Celsius or 225 degrees Celsius for 20 minutes. A Mullen™ Burst Strength Tester was used as is standard in the art, for measuring the burst strengths of the diaphragms. The burst strengths of these diaphragms are shown as function of the temperature to which they were heated, in Table 5 below:

TABLE 5

| Temp. (°C.) | Burst Strength (psi) |
|---|---|
| 225 | 8 |
| 300 | 10 |
| 335 | 120 |

What is claimed is:

1. A bonded non-asbestos chlor-alkali diaphragm comprising one or more water-wettable materials and one or more chemically-resistant materials, which is characterized by having a Macmullin number and average diaphragm thickness such that the product of these is between about 5 and about 30 millimeters when the average diaphragm thickness is measured in millimeters, and by a median pore size between about 0.1 microns and about 1 micron, wherein one or more of the chemically-resistant materials is or are coated with a durable, adherent coating of an ion-containing polymer or a thermoplastic precursor thereof which coating has been bonded into the diaphragm on the one or more chemically resistant materials, such that upon converting the thermoplastic precursor to a hydrophilic, ion-containing polymer and placing the diaphragm in use, the diaphragm exhibits a sustained increase in wettability and a sustained, decreased tendency to dewet and become gas-blinded as compared to a identically-prepared and characterized, bonded diaphragm which does not include such coated materials, or such that the diaphragm as bonded exhibits increased burst strength as compared to a diaphragm including one or more chemically-resistant materials which have been coated with an ion-containing polymer but which is not bonded.

2. A diaphragm as defined in claim 1, wherein the coating of one or more of the chemically-resistant materials in said diaphragm provides at least about a 30 kilowatt hour sustained, average reduction in power consumption per ton of caustic produced by using said diaphragm in a chlor-alkali cell at a given set of conditions, and at least about a 1.5 percent improvement on average in power efficiency, over an interval between shutdowns for rewetting which is at least about twice as long as the interval associated with a diaphragm made in an otherwise identical manner but not including an ionomer coating on the chemically-resistant materials used in the diaphragm.

3. A diaphragm as defined in claim 2, wherein the indicated, sustained average reduction in power consumption and improvement in power efficiency are realized over an interval between shutdowns for rewetting that is at least about 2.5 times that associated with a diaphragm made in an otherwise identical manner but not including an ionomer coating on the chemically-resistant materials used in the diaphragm.

4. A diaphragm as defined in claim 3, wherein the indicated, sustained average reduction in power consumption and improvement in power efficiency are realized over an interval between shutdowns for rewetting that is at least about three times that associated with a diaphragm made in an otherwise identical manner but not including an ionomer coating on the chemically-resistant materials used in the diaphragm.

5. A diaphragm as defined in claim 1, which is characterized by having a Macmullin number and average diaphragm thickness such that the product of these is between about 5 millimeters and about 25 millimeters when the average diaphragm thickness is measured in millimeters, and by a median pore size between about 0.1 microns and about 0.7 microns.

6. A diaphragm as defined in claim 5, which is characterized by having a Macmullin number and average diaphragm thickness such that the product of these is greater than about 8 millimeters when the average diaphragm thickness is measured in millimeters, and by a median pore size between about 0.1 microns and about 0.5 microns.

7. A diaphragm as defined in claim 1, which consists essentially of zirconium oxide and poly(tetrafluoroethylene) in fibrous and particulate forms, wherein at least one of the fibrous and particulate forms is coated as described in claim 1.

8. A diaphragm as defined in claim 7, wherein the coating is of an ion-containing polymer of the formula:

$$-(CF_2-CF_2)_a(CF_2-\underset{\underset{O_nCF_2CF_2SO_3H}{|}}{CF})_b-$$

, wherein n is 1 or greater and the ratio of a:b is about 7:1, or wherein the coating is of a thermoplastic, sulfonyl fluoride polymer precursor of such an ion-containing polymer.

9. A diaphragm as defined in claim 8, wherein the polymer coated on the PTFE or which is formed from the thermoplastic, sulfonyl fluoride precursor has an equivalent weight of about 500 to about 1500.

10. A diaphragm as defined in claim 7, wherein the coating is of an ion-containing polymer of the formula:

$$-(CF_2-CF_2)_a(CF_2-\underset{\underset{OCF_2CF_2SO_3H}{|}}{CF})_b-$$

, wherein the ratio of a:b is about 7:1, or wherein the coating is of a thermoplastic, sulfonyl fluoride polymer precursor of such an ion-containing polymer.

11. A diaphragm as defined in claim 10, wherein the polymer coated on the PTFE or which is formed from the thermoplastic, sulfonyl fluoride precursor has an equivalent weight of about 550 to about 1000.

12. A diaphragm as defined in claim 11, wherein the polymer coated on the PTFE or which is formed from the thermoplastic, sulfonyl fluoride precursor has an equivalent weight of about 800 or less.

13. A diaphragm as defined in claim 12, wherein the polymer coated on the PTFE or which is formed from the thermoplastic, sulfonyl fluoride precursor has an equivalent weight of about 650 or less.

14. A diaphragm as defined in claim 13, wherein the draw slurry from which the diaphragm is drawn contains from about 60 to about 81 percent by weight of zirconium oxide, from about 14 to about 31 percent by weight of PTFE particulate material, and from about 5 to about 9 percent by weight of PTFE in fibrous form.

15. A diaphragm as defined in claim 7, wherein the draw slurry from which the diaphragm is drawn contains from about 60 to about 81 percent by weight of zirconium oxide, from about 14 to about 31 percent by weight of PTFE particulate material, and from about 5 to about 9 percent by weight of PTFE in fibrous form.

16. A diaphragm as defined in claim 1, which is comprised of composite fibers including an inorganic, water-wettable particulate material which is bound in fibrils of a chemically-resistant polymeric material, and wherein the composite fibers include a durable, adherent coating of an ion-containing polymer or a thermoplastic precursor thereof on at least the chemically-resistant polymeric material in said composite fibers.

* * * * *